US006402054B1

(12) United States Patent
Prueter et al.

(10) Patent No.: US 6,402,054 B1
(45) Date of Patent: Jun. 11, 2002

(54) AIRLESS SQUEEZE BOTTLE ASPIRATOR

(75) Inventors: David M. Prueter, Olathe, KS (US); Steven L. Sweeton, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/779,112

(22) Filed: Feb. 9, 2001

(51) Int. Cl.[7] ..... B65D 1/32

(52) U.S. Cl. ..... 239/327; 239/469; 239/490; 239/491; 222/211; 222/212

(58) Field of Search ..... 239/327, 490, 239/491, 492, 493, 338, 468, 469; 222/215, 209, 211, 212, 213, 390

(56) References Cited

U.S. PATENT DOCUMENTS

| | | | | |
|---|---|---|---|---|
| 2,823,836 A | | 2/1958 | Bach | |
| 3,140,052 A | * | 7/1964 | McCuiston | 239/327 |
| 3,493,179 A | * | 2/1970 | Lee | 222/211 |
| 4,186,882 A | | 2/1980 | Szczepanski | |
| 4,196,857 A | * | 4/1980 | Bauer | 239/327 |
| 4,809,914 A | * | 3/1989 | Goncalves | 239/327 |
| 5,275,338 A | * | 1/1994 | Tobler | 222/211 |
| 6,250,568 B1 | * | 6/2001 | Prueter | 239/327 |

* cited by examiner

*Primary Examiner*—Steven J. Ganey
(74) *Attorney, Agent, or Firm*—Dykema Gossett PLLC

(57) ABSTRACT

An airless squeeze bottle sprayer comprised of a tube retainer, an orifice cup and a closure. The tube retainer has a product outlet port, a post, and at least one tangential apertures through which fluid is expelled from within the container. The orifice cup has an annular mixing or turbulence chamber wherein the fluid from within the container is mixed up before being expelled out of the orifice cup through a discharge orifice. A dip tube depends from the tube retainer and defines a path for the fluid from the bottom of the container to the annular mixing chamber. When the container is squeezed, fluid is forced up through the dip tube into the mixing chamber and out of the container through the discharge orifice in the orifice cup. Any air that is introduced into the container and expelled out of the container is done so through the same path as the fluid, the sprayer lacks any distinct or separate air ports.

10 Claims, 1 Drawing Sheet

AIRLESS SQUEEZE BOTTLE ASPIRATOR

BACKGROUND OF THE INVENTION

This invention relates generally to a hand operable sprayer and more particularly to a squeeze bottle aspirator that sprays or dispenses course material from the squeeze bottle without separate air ports to introduce and expel air from within the bottle.

Spraying devices common in the marketplace generally use air to form an air jet which facilitates the expulsion of fluids by atomizing the fluid before it is expelled from the spraying device out into the atmosphere. Most aspirators have a dispensing closure that incorporates a dip tube which allows for fluid to be conveyed from the lower portion of the container when the bottle is squeezed. The dispensing closure has an exit orifice integrally formed therewith. The dip tube is attached to the dispensing closure in a cylindrical attachment port on the side facing the interior of the container. The cylindrical port has a plurality of thin ribs spaced radially and extending axially along its inside diameter. When the dip tube is inserted into the cylindrical port, the ribs in conjunction with the outside diameter of the dip tube create gaps or channels between the inner diameter of the cylindrical port and the outside diameter of the dip tube. These channels allow air to be forced into the fluid stream as the bottle is squeezed. The air is entrained into the fluid flow causing turbulence of the fluid as it mixes and exits the aspirator through the orifice of the closure.

A consideration of this solution is that the fluid is finely atomized, which requires the addition of air to the fluid. However, there is a need for a fluid to be sprayed without being atomized or mixed with air. The present device is designed so the fluid is expelled from the sprayer, in the form of a coarse spray, without any air being mixed therewith.

SUMMARY OF THE INVENTION

It is an object of the present invention to provide a sprayer that lacks separate air intake ports, yet can dispense material from within a bottle.

The present invention may be used with squeeze bottles currently known in the art, rendering the sprayer economical as well as easy to use.

According to the present invention, the spraying device is comprised of a tube retainer, an orifice cup and a closure.

The tube retainer has a product outlet port, a post, and at least one tangential aperture through which fluid is expelled from within the container.

The orifice cup has an annular mixing or turbulence chamber wherein the fluid from within the container is agitated before being expelled out of the orifice cup through a discharge orifice.

A dip tube depends from the tube retainer and defines a path for the fluid from the bottom of the container to the annular turbulence chamber.

When the container is squeezed, fluid is forced up through the dip tube into the mixing chamber and out of the container through the discharge orifice in the orifice cup. Any air that is introduced into the container and expelled out of the container is carried out through the same path as the fluid. The sprayer lacks any distinct or separate air ports.

Other objects, advantages and novel features of the invention will become more apparent from the following detailed description of the invention when taken in conjunction with the accompanying drawings.

DETAILED DESCRIPTION OF THE INVENTION

Figures 1, 2, 3, 4:
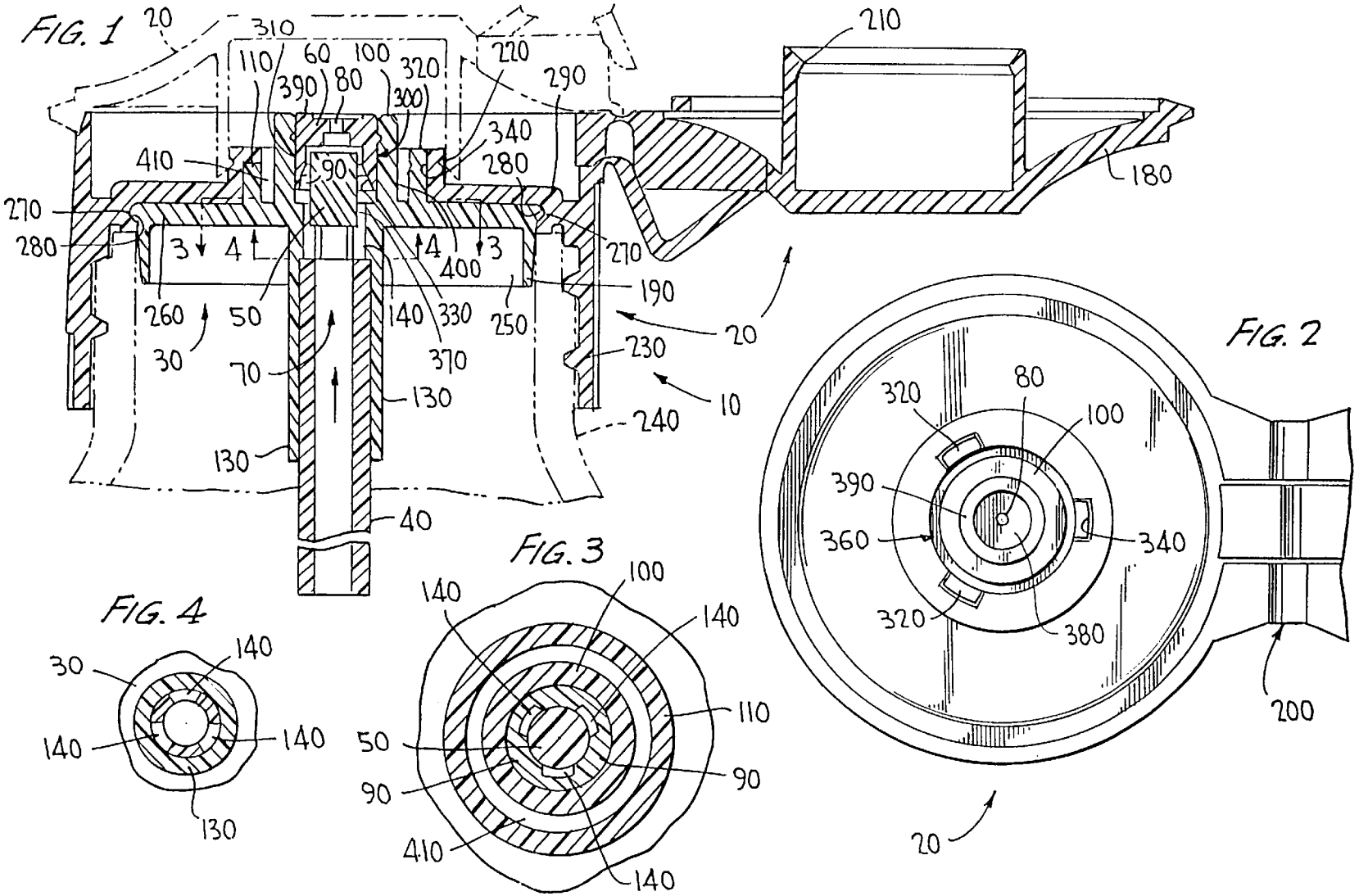
FIG. 1 is a partial cross-sectional view of the airless squeeze bottle aspirator of the present invention, the aspirator being mounted on a squeeze bottle and having a closure attached thereto.
FIG. 2 is a partial top plan view of the orifice cup and closure portions of the aspirator of FIG. 1.
FIG. 3 is a partial cross-sectional view of the tube retainer portion of the aspirator of the present invention as taken along line 3—3 in FIG. 1.
FIG. 4 is a partial cross-sectional view of the tube retainer portion of the aspirator of the present invention taken along line 4—4 in FIG. 1.

FIG. 1 shows an airless squeeze bottle aspirator 10 which is comprised of a closure generally designated 20, the closure having a lid 180 that is shown in solid lines in an open position and shown in phantom lines in a closed position. The closure 20 is connected to a container 240 and supports a tube retainer 30. The lower portion 230 of the closure 20 may be mounted to the upper end of the container 240 while the lid portion 180 of the closure 20 is used as a protective cover that can be opened when the container 240 is in use. Container 240 typically has a collapsible wall or collapsible wall portion to facilitate manual squeezing.

Tube retainer 30 includes an integral plug seal 250 or the like for tightly sealing the tube retainer 30 and closure 20 to the container 240 from fluid leakage without the need for a sealing gasket.

The tube retainer 30 is comprised of a top 260 having a plug seal 250 depending downwardly from the outer edge of the top 260. The lower end 190 of the plug seal 250 is chamfered to allow the tube retainer 30 to be easily inserted into the container 240. A lip 270 is formed on the upper end of the plug seal 250 which matingly corresponds to a channel 280 in the intermediate portion 290 of the closure 20. When assembled, the lip 270 is snapped into place within the channel 280 thereby securing the tube retainer 30 within the closure 20. Located in the central area of the tube retainer 30 and depending therefrom into the interior of the container 240 is a tube extension 130. The end of the dip tube 40 is inserted into the tube extension 130 wherein it is frictionally retained therein.

A central post 50, an inner vertical wall 100 and an outer vertical wall 110 are located in the middle portion of the top 260 of the tube retainer 30. The inner vertical wall 100 defines a central area 360 which encircles the post 50 that is located centrally therein. An orifice cup 60 is located within the central area 360 and encapsulates the post 50.

As shown in FIG. 2, the outer vertical wall 110 encircles the inner vertical wall 100 and has slots 340 spaced equidistantly around the outer vertical wall 110. Each slot 340 correponds to a lug 320 that is formed on the tube retainer 30. When the lugs 320 are positioned within the slots 340, the closure 20 is prevented from rotating relative to the tube retainer 30.

The orifice cup 60, located within the central area 360, is supported by the tube retainer 30 and is comprised of a side wall 310 and a top 380. The inner surface 330 of the side wall 310 is spaced from the outer surface 370 of the post 50 to define therebetween the annular mixing or turbulence chamber 90. During operation of the airless aspirator, to be more fully described hereafter, fluid from within the container 240 can be forced into the annular turbulence chamber 90 thereby creating a turbulence that breaks up the fluid before it is expelled from the aspirator. The side wall 310 of the orifice cup 60 encircles the post 50.

The top portion 380 of the orifice cup 60 has a discharge orifice 80 therein that allows the spray to exit the turbulence chamber 90 unobstructed. The side wall 310 is used during assembly of the device and allows for the orifice cup 60 to be pushed into or forced down into the tube retainer 30 so that it is attached to the tube retainer 30.

A rim 390 may be formed around the outer perimeter of the top portion 380 of the orifice cup 60. The rim 390 helps to maintain straying discharge fluid in the vicinity of the discharge orifice 80 and helps to prevent it from running down the inner vertical wall 100. However, should any fluid escape the rimmed portion of the orifice cup 60, the fluid may run down the outer surface 400 of the inner vertical wall 100 where it is retained within an excess channel 410. When the orifice cup 60 is attached to the tube retainer 30, the annular turbulence chamber 90 surrounds the post 50.

The discharge orifice 80 is located in the top portion 380 of the orifice cup 60 and is spaced from the post 50 (FIG. 1). The axis of the discharge orifice 80 is coincident with the axis of the post 50. The inner wall of the orifice cup 60 may be sloped away from the post 50 in such a manner as to form a wider chamber 90 toward the tube retainer 30. The wider portion of the turbulence chamber 90 is located adjacent the fluid ports 140 (FIGS. 3 and 4) formed in the tube retainer 30.

As shown in FIGS. 3 and 4, a plurality of fluid ports 140 are formed in the tube retainer 30 adjacent the lower part of the post 50. These fluid ports 140 are formed in the upper portion of the tube extension 130 and are equidistantly spaced around the interior diameter thereof. The tube extension 130 is in communication with a dip tube 40 at one end and is integrally formed with a portion of the post 50 at the opposite end. The post 50 is primarily cylindrical in shape and has an outer surface 370, however it can also be frusto-conical in shape if desired.

A product passage 70 extends from a point within the container 240 and continues through the fluid ports 140 adjacent the lower portion of the post 50 into the turbulence chamber 90.

The dip tube 40 is adapted to extend into a liquid product (not shown) in the container 240 with one end located near the bottom of the container 240 and the other end communicating with the product passage 70 thus providing a pathway for the fluid to travel from the bottom of the container 240 up and into the annular turbulence chamber 90. The dip tube 40 allows product to be expelled easily from within the container 240 to the turbulence chamber 90 regardless of how much product is present in the container 240.

Air is prevented from escaping the container 240 when the lower end of the dip tube 40 is emerged or lowered in product within the container 240.

To operate the airless squeeze bottle aspirator 10 of the present invention, the user grasps the container 240 in one hand and squeezes the container 240 between the thumb and fingers forcing fluid from the bottom of the interior of the container 240 up through the dip tube 40 and into the turbulence chamber 90 where it is broken up and forced from the container 240. Commonly know principles of spin mechanics are used within the turbulence chamber 90 wherein the product emerging from the fluid ports 140 is swirled upon entering the turbulence chamber 90. Within the turbulence chamber 90, tangentials are formed on the inside of the orifice cup 60. The tangentials break up the fluid causing it to become a coarse spray as it is expelled from the turbulence chamber 90 through the discharge orifice 80 out into the atmosphere or onto a target surface. The particle size of the sprayed fluid can be controlled by the size of the discharge orifice 80.

As known in the art, compression of the container 240 causes the discharge whereas releasing of the compressed container 240 allows air to be sucked into the container 240 from the atmosphere, through the discharge orifice 80 and into the turbulence chamber 90 where it is then dispersed through the fluid ports 140 to the interior of the container 240 for refilling the upper portion of the container 240 with air as in the normal manner.

Although particular embodiments of the. invention have been described in detail herein with reference to the accompanying drawings, it is to be understood that the invention is not limited to those precise embodiments, and that various changes and modifications are possible.

Some foreseeable alternative embodiments may include a three piece construction instead of the four piece embodiment herein illustrated. The three piece construction would be similar to the present embodiment with the closure and the tube retainer being a single, unitary piece instead of two separate elements.

Also, while the present embodiment shows the lid 180 connected to the closure to 20 at location 420 as a live hinge, the lid 180 may or may not form a part of the claimed invention and various other types of hinges or attachments may be used. The aspirator 10 may be made and used without a lid 180 or the like attached thereto at all. Such changes and modifications may be effected by one skilled in the art without departing from the scope or spirit of the invention as defined in the appended claims.

What is claimed is:

1. A spraying device for a squeeze bottle having a hollow interior, comprising:

a dip tube adapted to be disposed within a product in a squeeze bottle, said dip tube having an open upper end;

a tube retainer for supporting said dip tube, said tube retainer including a post having an outer surface, and said dip tube having a substantially fluid tight connection with said tube retainer;

an orifice cup supported by said tube retainer, said orifice cup including a discharge orifice, said orifice cup having an inner wall defining a cavity therewithin for receiving said post, said inner wall and said outer surface defining therebetween a turbulence chamber in communication with said discharge orifice;

a closure adapted to be connected to a squeeze bottle, said tube retainer supported by said closure; and passage means formed within said tube retainer, said passage means being in communication with the open upper end of said dip tube and said turbulence chamber, said passage means providing the sole means of communication between said discharge orifice and the interior of said squeeze bottle;

whereby upon manually squeezing the bottle, air from within the squeeze bottle cannot mix with the product discharged from said discharge orifice.

2. The spraying device as defined in claim 1, wherein:

said post outer surface includes a side surface and a top surface;

said inner wall of said orifice cup including a first surface portion spaced from said side surface of said post, said inner wall of said orifice cup including a second surface portion spaced form said top surface of said post.

3. The spraying device as defined in claim 2, wherein:

said second surface portion of said orifice cup and said top surface of said post define therebetween tangential passages for creating a swirling path for liquid passing to said discharge orifice.

4. The spraying device as defined in claim 1, wherein:

said passage means includes a plurality of passage portions defined between the outer surface of said post and a spaced inner surface of said retaining means.

5. The spraying device as defined in claim 4, wherein:

said passage portions are spaced equidistantly from one another around said post.

6. The spraying device as defined in claim 1, including a plurality of spaced stop members extending downwardly from said post for engaging the upper end of said dip tube.

7. The spraying device as defined in claim 6, wherein:

said spaced stop members define therebetween a plurality of openings providing communication between said passage means and said open upper end of said dip tube.

8. The spraying device as defined in claim 1, wherein:

said passage means includes a plurality of passage portions defined between the outer surface of said post and a spaced inner surface of said retaining means;

said passage portions being spaced equidistantly from one another around said post;

a plurality of spaced stop members extending downwardly from said post for engaging the upper end of said dip tube;

said spaced stop members defining therebetween a plurality of openings providing communication between said passage means and said open upper end of said dip tube;

said passage portions being offset from said openings.

9. The spraying device as defined in claim 1, further comprising:

a lid pivotally supported by said closure.

10. The spraying device as defined in claim 1, wherein:

said tube retainer has spaced, upwardly extending lugs thereon; and said closure having slots formed therein for receiving said lugs to prevent relative rotation between said tube retainer and said closure.

* * * * *